United States Patent [19]

Limpaecher

[11] 4,237,404

[45] Dec. 2, 1980

[54] SPARK GAP CONTROL

[75] Inventor: Rudolf Limpaecher, Topsfield, Mass.

[73] Assignee: Avco Everett Research Laboratory, Inc., Everett, Mass.

[21] Appl. No.: 40,197

[22] Filed: May 18, 1979

[51] Int. Cl.[3] ..... H01J 7/24; H05B 31/26

[52] U.S. Cl. ..... 315/111; 315/358; 313/231

[58] Field of Search ..... 315/111, 340, 358; 361/116, 121, 123; 313/120, 231, 231.1, 231.2; 200/148 G; 324/465

[56] References Cited

U.S. PATENT DOCUMENTS

| | | | |
|---|---|---|---|
| 3,122,062 | 2/1964 | Spivak et al. | 91/3 |
| 3,327,726 | 6/1967 | Hatch, Jr. | 137/819 |
| 3,480,829 | 11/1969 | Van Ornum | 313/231.7 |
| 3,579,034 | 2/1969 | Jensen | 315/340 |
| 3,660,625 | 5/1972 | Allen, Jr. | 200/148 J |
| 4,027,187 | 5/1977 | Rabe | 313/231 |

*Primary Examiner*—Alfred E. Smith
*Assistant Examiner*—Thomas P. O'Hare
*Attorney, Agent, or Firm*—M. E. Frederick

[57] ABSTRACT

A high repetition rate high power spark gap switch of the type useful in pulsed lasers, radar systems and pulse-forming networks is enabled to operate with higher switching speed at high power levels by rapid chemical composition change cyclically made in the spark gap at high frequency with differing standoff voltage capabilities of different compositions produced in the gap in each cycle. The different standoff voltage capabilities are produced by injecting different gases under fluidic switching control.

9 Claims, 4 Drawing Figures

SPARK GAP CONTROL

BACKGROUND OF THE INVENTION

The present invention relates to high repetition rate, high power spark gap switches of the type used in pulsed lasers, radar systems and pulse forming networks.

Typically in prior art applications, a capacitor or the like is charged to a voltage while the switch isolates the load during the quiescent or charging period of each firing cycle. At the moment of firing, the switch is made conducting and the charge on the capacitor or the like is discharged through the load after which the switch is made nonconducting and the capacitor permitted to be recharged. Since the capacitor or the like cannot be charged up while the switch is in the conducting state, the time it takes to render the switch nonconducting plus the time it takes to recharge establishes the maximum pulse repetition rate.

The state of the art in these devices generally is indicated by U.S. Pat. No. 4,027,187 and the references cited therein. There, a blowing out of residual hot gases and discharge products from the spark gap is enhanced by provision of an annular deLaval nozzle to provide a superior high repetition rate of physical sweeping away which reduced the necessary cycle period (i.e., increases allowable frequency of sparking). Physically blowing away gap gases is also shown in U.S. Pat. No. 3,480,829 in an arc light at DC (or in AC or pulse mode at unspecified frequency).

It is an important object of the present invention to provide still further frequency increase, in high power level spark gap switching one or more kilohertz compared to the 0.1–0.5 kilohertz frequency of the above state of the art.

SUMMARY OF THE INVENTION

The said object is realized in accordance with the invention by cyclically changing chemical composition within the spark gap by cyclic injection therein of different gases. A different standoff voltage capability is associated with each chemical composition. Thus higher voltages can be developed in the presence of gas with high standoff voltage and sparking can be initiated by replacing such gas with a lower standoff voltage gas. Injecting different gases at kilohertz level frequencies is made possible by fluidic switching. Fluid amplifiers have been used to drive breaker contacts—see e.g. U.S. Pat. No. 3,660,625 of May 2, 1972; but I have now discovered the importance of direct use of fluidic devices on gases to provide spark interruption through composition change.

Pressure in the spark gap can be varied through conventional means to adjust sparking conditions. Typically, the pressure in the spark gap is of the order of 75 psia, while that in the fluid switching devices may be 200 psia or more, and the pressure in the exhaust region downstream of the spark gap about atmospheric. But the fluidic injection means are made independent of such back pressure conditions through sonic orifice isolation. Such isolation also prevents random variations in back pressure from affecting the controlled injection of gases for predetermined cyclic compositional change.

These and other objects, features and advantages of the invention will be apparent from the following detailed description with reference therein to the accompanying drawings in which:

DETAILED DESCRIPTION OF PREFERRED EMBODIMENTS

Figure 1:
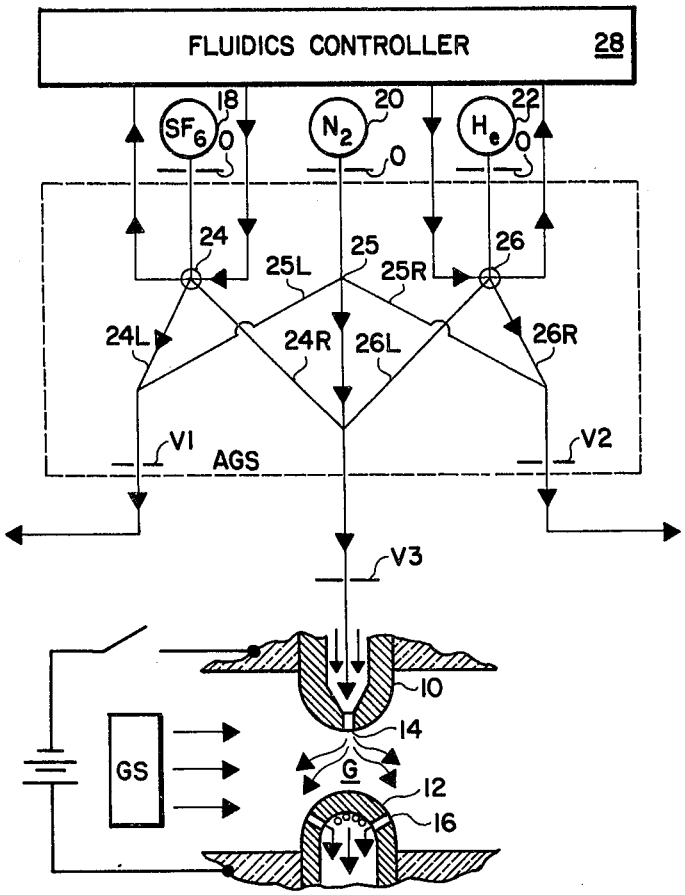
FIG. 1 is a cross section view of a spark gap device together with a fluid circuit diagram of gas injection means in accordance with a preferred embodiment of the invention utilizing three gases.

Referring now to FIG. 1, there is shown a spark gap comprising electrodes 10 and 12. A first gas source GS and an auxiliary gas source AGS are also provided, the latter utilizing passage 14 and 16 of the electrodes 10 and 12. Alternatively, alternative gas source AGS can constitute the sole source of main and auxiliary gases (one or more) admitted cyclically and sequentially to the spark gap. The flow path of gases between the passages 14 and 16 and high pressurized feed thereof assures exclusion of ambient gas (or of a main gas admitted at GS) for high response.

In a particularly desirable application of the invention, for a high frequency spark gap usable on radar systems, laser systems and other pulse-forming networks, sources of, for example, sulfur hexafluoride, nitrogen and helium are provided at 18, 20 and 22 for admission via sonic orifices O to flow passages including fluidic switches at 24 and 26 operated by control jets in conventional manner provided by a fluidics controller 28. Exhaust sonic orifices are provided at V1 and V2 for the sulfur hexafluoride and helium when not admitted to passage 14 in electrode 10.

The nitrogen is generally admitted to the gap G in the arrangement shown and has a standoff capability on the order of 30 kilovolts per cm-atmosphere, that of the helium being much lower and that of the sulfur hexafluoride being much higher.

In the standby condition of a three-gas system, as shown in FIG. 1, helium flows through switch 26, conduit 26R and is vented through orifice V2; sulfur hexafluoride flows through switch 24, conduit 24L and is vented through orifice V1, and nitrogen flows through junction 25, orifice V3 and passage 14 into the gap G providing a standoff voltage of about 30 kV per centimeter-atmosphere. With the $SF_6$ directed to 24L and the $H_e$ to 26R, the nitrogen from junction 25 will find the least resistance to flow through orifice V3. Some small amount of nitrogen will become entrained in the sulfur hexafluoride stream at switch 24 and into the helium stream at switch 26 and be exhausted through orifices V1 and V2, respectively. At the start of the cycle, fluidics controller 28 provides a deflecting control jet at the right of switch 26 causing the helium to flow through conduit 26L, orifice V3 and passage 14 into the gap G. This will force the nitrogen flow from junction 25 to deflect through conduit 25R so as to substitute for the helium flow through orifice V2. This occurs automatically and maintains the pressure across orifice V2. Some small amount of nitrogen will become entrained in the helium and flow into gap G with the helium. As the helium replaces nitrogen in the gap G, the standoff voltage of the gap drops and the gap becomes conducting. This is one mode of operation where the spark gap breakdown of device trigger is accomplished with the fast gas change in the central region of the spark gap. Once the discharge through the gap is complete, it is important to make the spark gap less conductive so that the process of recharging the energy storage device (or pulse forming network) may begin as soon as possible.

For this purpose, the fluidics controller 28 provides deflecting control jets at the left of switches 24 and 26 causing sulfur hexafluoride to flow in conduit 24R, through orifice V3 and passage 14 into gap G and helium to flow through conduit 26R and through orifice V2. The nitrogen will now flow through conduit 25L and V1 substituting for the sulfur hexafluoride flow. This again will maintain the pressure across orifices V1, V2 and V3. As the sulfur hexafluoride replaces the helium in the gap, the standoff voltage rises rapidly and the gap becomes nonconducting in a minimum amount of time. Once the standoff voltage of the gap reaches or exceeds approximately that of $VN_2$, the fluidics controller 28 provides a deflecting control jet at the right of switch 24 causing the flow of sulfur hexafluoride to switch from conduit 24R to conduit 24L and to flow through orifice V1 while nitrogen from source 20 flows through junction 25 into conduit 24R and through orifice V3. At this point, the gap G and the switch will return to the standby condition.

Figure 2:
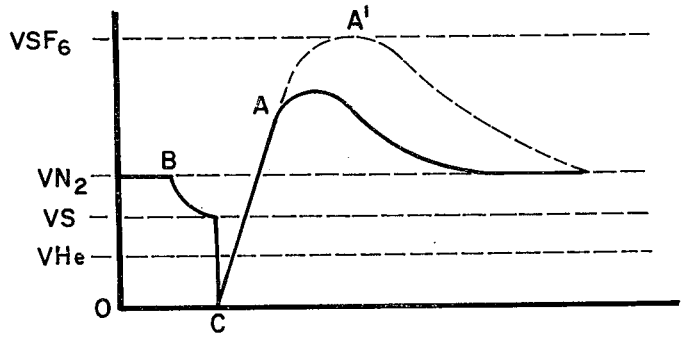
FIG. 2 is a time trace of cyclic rises and falls of spark gap standoff voltage achieved through use of the FIG. 1 apparatus.

The above-described sequencing of gases and resultant effect on voltage standoff is graphically indicated in FIG. 2. The basic standoff voltage of nitrogen, air or the like is indicated at $VN_2$ and the curve begins at step B after helium or the like has been injected to depress the standoff voltage. When the standoff voltage drops below the voltage to be switched, indicated on the figure at $V_S$, the gap breaks down and conducts. The resulting arc heats the gas in the gap and the standoff voltage drops to point C far below the standoff voltage of the helium. At that point, sulfur hexafluoride is injected via passage 14 neutralizing any residual electrons and diluting and cooling the hot helium causing the standoff voltage of the gap to rise. At some point during the rise of the standoff voltage, the recharging of the pulse forming network may begin and continue during the time and standoff voltage of the gap is rising. The charging voltage may not exceed a value which will cause the gap to refire. As $SF_6$ replaces the $N_2$ in the gap, the standoff voltage rises to some point A which is intermediate between $VN_2$ and $VSF_6$. At this point $N_2$ alone is injected into the gap and the standoff voltage of the gap drops to $VN_2$, putting the gap in the standby condition. Alternately, the flow of $SF_6$ into the gap may be permitted to continue until the standoff voltage rises to A', the standoff voltage of pure $SF_6$, at which time $N_2$ alone is injected into the gap. As $N_2$ replaces $SF_6$, the standoff voltage of the gap drops to $VN_2$.

The above description is of a three-gas system using a gas such as sulfur hexafluoride to obtain a fast voltage standoff recovery of the gap and a gas such as helium to break down the gap. Nitrogen may be used for the standby mode once the gap has completely recovered. The selection of gases to be used in the switch, which may be made according to well-known principles, is such that the standoff voltage is high enough to prevent spontaneous firing yet low enough to ensure that the firing will occur at some specific time after the gas which causes the gap to break down is injected. Generally, the selection is made such that the standoff voltage of the gap is approximately 1.2 times the voltage to be switched by the gap.

Figure 3:
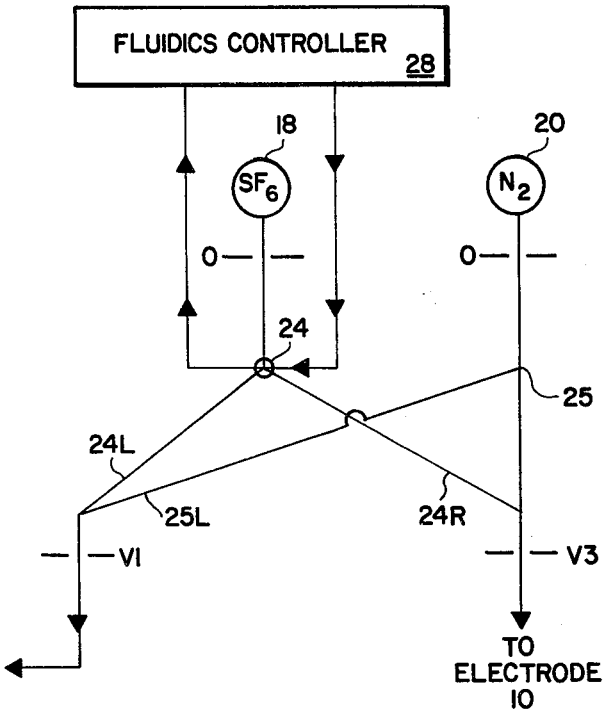
FIG. 3 is a fluid circuit diagram of gas injection means in accordance with a preferred embodiment of the invention utilizing two gases.

Referring now to FIG. 3, there is shown a fluid circuit diagram of gas injection means in accordance with a preferred embodiment of the invention utilizing two gases. In this embodiment a gas such as $SF_6$ is used for fast recovery of the standoff voltage of the gap and a second gas such as $N_2$ is used to stand off the gap voltage during the standby condition. The gap is triggered by an electrical trigger means, but may be triggered by other means, for example, by irradiating the gap with ultraviolet radiation. In the standby condition, $N_2$ flows from 20 through sonic orifice V3 and to electrode 10 and $SF_6$ flows from source 18 through switch 24, conduit 24L and is vented through sonic orifice V1. After the gap has been fired, fluidics controller 28 provides a deflecting control jet to the left of switch 24 causing the flow of $SF_6$ to transfer from conduit 24L to 24R and to flow through orifice V3 to electrode 10 and the $N_2$ to flow through 25L and be exhausted through V1. As $SF_6$ replaces $N_2$ in the gap, the standoff voltage rises to a value greater than $VN_2$, i.e., to a standoff voltage greater than the standoff voltage of the gap when it is in the standby condition. At this point, the fluidics controller provides a deflecting control jet to the right side of switch 24 causing the flow of $SF_6$ to switch from conduit 24R to conduit 24L and to be exhausted through V1 and the nitrogen to flow through V3 to electrode 10. As the nitrogen replaces the sulfur hexafluoride in the gap, the standoff voltage drops to that of $N_2$, i.e., the gap returns to the standby condition.

Figure 4:
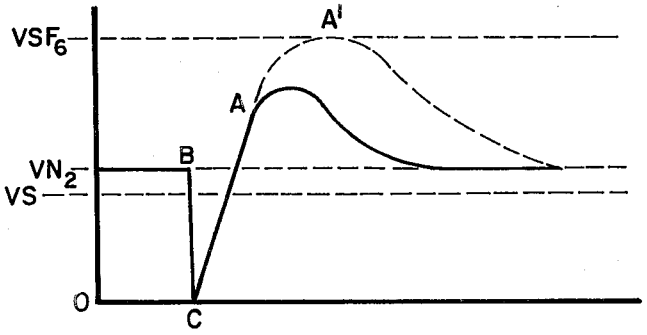
FIG. 4 is a time trace of cyclic rises and falls of spark gap standoff voltage achieved through use of the FIG. 3 apparatus.

Referring now to FIG. 4, at the start of the cycle, $N_2$ is flowing into gap causing it to be in the standby condition. At a time B an electrical trigger causes the gap to break down and the charge stored in the pulse forming network or the like to flow through the spark gap into the load. The resulting arc ionizes and heats the gas in the gap causing the standoff voltage of the gap to drop to point C far below the standoff voltage of nitrogen. At time C, $SF_6$ is injected into gap G. The $SF_6$ neutralizes any residual electrons, dilutes and cools the hot nitrogen and causes the standoff voltage of the gap to rise. At some point during the rise of the standoff voltage of the gap, recharging may begin and continue during the time the standoff voltage of the gap is rising. The charging voltage may not exceed a value which will cause the gap to refire. As the $SF_6$ replaces the $N_2$ in the gap, the standoff voltage rises to some point A which is intermediate between $VN_2$ and $VSF_6$. At this time, nitrogen alone is injected into gap G so as to replace $SF_6$ and the standoff voltage drops to $VN_2$ putting the gap in the standby condition. Alternately, the flow of $SF_6$ into the gap may be permitted to continue until the standoff voltage rises to A', the standoff voltage of $SF_6$ at which time, $N_2$ alone is caused to flow into the gap. As $N_2$ replaces $SF_6$, the standoff voltage of the gap drops to that of $N_2$ and the gap goes into the standby condition.

This process may be cyclically repeated in either the three-gas or the two-gas mode at repetition rates on the order of one or more kilohertz and at current levels in excess of 1 megaamp and above 1 megavolt well above the capabilities (in power) of thyratrons or the like and well above the frequency/power capabilities of state of the art spark gaps.

The fluidic controller 28 may be the type described in my paper (with Woodroffe, "Flameout In Repetitively-Pulsed Chemical Lasers", given at the Jan. 24, 1977, U.S. Aerospace Sciences meeting of the AIAA, Paper No. 77-61 of said meeting published by the AIAA, 1290 Avenue of the Americas, New York NY 10019). The degree of control may be enhanced by incorporating the improvements to such apparatus disclosed in my copending application, Ser. No. 040195, filed May 18, 1979, simultaneously with this application. When this is done, the gas injection power, jet and control jet pressures are wholly isolated from pressure changes in and around gap G.

Although the invention has been described as using a combination of either sulfur hexafluoride, nitrogen and helium, or sulfur hexafluoride and nitorgen, it will be appreciated that combinations of other gases could be used and that the gas or combination of gases selected will depend on the physical parameters of the spark gap. Tungsten hexafluoride or molybdenum hexafluoride might be used for example in place of sulfur hexafluoride, other rare gases might be substituted for helium and air for nitrogen. Further, while the nitrogen flow portion has been described as simply utilizing a junction, it is to be understood that a conventional controlled fluidic switch similar to switches 24 and 25 can be substituted for junction 25 as well as an unstable switch sensitive to changes in back pressure.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. In a high frequency, cyclic (over 1000 Hz) arc-/recovery spark gap process, the improvement comprising:

injecting multiple control gases of different compositions into the spark gap region under fluidic switching control at different times during the arc/recovery cycles, a first one of said control gases being selected to elevate spark gap breakdown voltage to enhance recovery and a second one of said gases being selected to depress spark gap breakdown voltage and enhance triggering.

2. Improved high frequency cyclic arcing, spark gap control process of claim 1 wherein at least a third control gas selected as a derated substitute for one of the said first and second control gases to provide an intermediate control level between the levels afforded by said first and second control gases is injected in alternation with the first and second control gases.

3. Improved high frequency, cyclic arcing spark gap control process in accordance with either of claims 1 or 2 and further comprising adjusting pressure in the spark gap region to adjust breakdown voltage therein, while isolating the fluidic switching of control gas from the effect of pressure change.

4. In an arc/recovery spark gap process wherein said spark gap is actuated at over 1000 cycles per second, the improvement comprising:

providing a source of a first gas having a breakdown voltage greater than that at which said spark gap is to operate;

under fluidic switching alternately directing said first gas to the spark gap and then to a vent, said first gas being directed to said vent at the beginning of an arcing cycle and to said spark gap at the termination of an arcing cycle of said spark gap to enhance termination of said arcing cycle;

providing a source of a second gas having a breakdown voltage less than that at which said spark gap is to operate; and providing a flow passage for said second gas to said spark gap and a flow passage to a vent whereby when said first gas flows to said spark gap, said second gas flows substantially only to said vent, and when said first gas flows to said vent, said second gas flows substantially only to said spark gap, said second gas being directed to said spark gap at the beginning of an arcing cycle to enhance actuation of said arcing cycle.

5. The spark gap process of claim 4 wherein a third gas having a breakdown voltage intermediate that of said first and second gases is supplied under fluidic switching to said spark gap and then to the vent in alternation with said first and second gases, said first and second gases being directed to vent when said third gas is directed to said spark gap and said third gas being directed to vent when said first and second gases are directed to said spark gap.

6. In a high frequency cyclic (over 1000 Hz) spark gap apparatus with electrodes and means for forming a spark gap and source of ambient gas therebetween, the improvement comprising:

means for injecting multiple control gases of different compositions into the spark gap region under fluidic switching control at different times during arc recovery cycles.

7. Improved high frequency spark gap apparatus in accordance with claim 6 and further comprising:

means for injecting at least a third control gas into the spark gap in alternation with said first and second control gases.

8. Improved high frequency spark gap apparatus in accordance with either of claims 6 or 7 and further comprising:

means for adjusting pressure in the spark gap region to adjust breakdown voltage therein, while isolating the fluidic switching of control gas from the effect of pressure change.

9. In a spark gap apparatus with electrodes and means for forming a spark gap, the improvement comprising:

means for providing a source of first gas having a breakdown voltage greater than that at which said spark gap is to operate;

fluidic switching means for alternately directing said first gas to the spark gap and to vent;

means for actuating said fluidic switching means to direct said first gas to said spark gap during at least a portion of the non-arcing portion of each cycle to enhance termination of said arcing cycle;

means for providing a source of a second gas having a breakdown voltage less than that at which said spark gap is to operate; and a first flow passage for directing said second gas to said spark gap and a second flow passage for directing said second gas to said vent whereby when said first gas flows to said spark gap, said second gas flows substantially only to said vent, and when said first gas flows to said vent, said second gas flows substantially only to said spark gap.

* * * * *